US010773942B2

(12) United States Patent
Zemko et al.

(10) Patent No.: US 10,773,942 B2
(45) Date of Patent: Sep. 15, 2020

(54) FROZEN BEVERAGE DISPENSING MACHINES WITH MULTI-FLAVOR VALVES

(71) Applicant: Cornelius, Inc., Osseo, MN (US)

(72) Inventors: Christopher F. Zemko, Elgin, IL (US); Vincenzo DiFatta, Wood Dale, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 16/146,470

(22) Filed: Sep. 28, 2018

(65) Prior Publication Data

US 2019/0031483 A1 Jan. 31, 2019

Related U.S. Application Data

(63) Continuation of application No. 15/585,974, filed on May 3, 2017, now Pat. No. 10,138,107.

(60) Provisional application No. 62/332,258, filed on May 5, 2016.

(51) Int. Cl.

| | |
|---|---|
| ***B67D 1/00*** | (2006.01) |
| ***B67D 1/07*** | (2006.01) |
| ***B67D 1/12*** | (2006.01) |

(52) U.S. Cl.

CPC ..... *B67D 1/0048* (2013.01); *B67D 1/0021* (2013.01); *B67D 1/0028* (2013.01); *B67D 1/0046* (2013.01); *B67D 1/0081* (2013.01); *B67D 1/07* (2013.01); *B67D 1/1218* (2013.01)

(58) Field of Classification Search

CPC ..... B67D 1/07; B67D 1/0021; B67D 1/0048; B67D 1/0081; B67D 1/0028; B67D 1/0046; B67D 1/1218

USPC ..... 222/129.1, 145.5–145.6, 145.1, 148, 150

See application file for complete search history.

(56) References Cited

U.S. PATENT DOCUMENTS

| | | | | |
|---|---|---|---|---|
| 2,566,436 A | | 9/1951 | Waite | |
| 3,272,388 A | * | 9/1966 | Whitmore | A23G 9/281 222/129.1 |
| 3,744,764 A | | 7/1973 | Sedam | |
| 4,201,558 A | | 5/1980 | Schwitters et al. | |
| 4,203,461 A | | 5/1980 | Schwitters | |
| 4,708,266 A | | 11/1987 | Rudick | |
| 4,793,520 A | * | 12/1988 | Gerber | A23G 9/28 222/129.1 |

(Continued)

FOREIGN PATENT DOCUMENTS

WO 2007070031 6/2007

OTHER PUBLICATIONS

International Search Report and Written Opinion, PCT/US2017/031183, dated Jul. 18, 2017.

*Primary Examiner* — Paul R Durand
*Assistant Examiner* — Andrew P Bainbridge
(74) *Attorney, Agent, or Firm* — Andrus Intellectual Property Law, LLP

(57) ABSTRACT

A beverage machine includes a valve that receives a base fluid and dispenses a mixed beverage comprising the base fluid and an additive fluid. The valve has a bore through which the base fluid flows, and the bore has a perimetral surface that defines a plurality of ports through which the additive fluid is injected to thereby mix with the base fluid. An injector is coupled to the valve and configured to radially inject the additive fluid into the base fluid through the plurality of ports as the base fluid flows through the bore such that the additive fluid mixes into the base fluid to form the mixed beverage.

12 Claims, 9 Drawing Sheets

(56) References Cited

U.S. PATENT DOCUMENTS 5,570,822 A * 11/1996 LeMarbe ..... B67D 1/0027 222/129.1
5,758,571 A * 6/1998 Kateman ..... A23G 9/04 99/455
6,095,371 A 8/2000 Mooney
6,220,047 B1 * 4/2001 Vogel ..... A23G 9/045 62/342
6,689,410 B2 * 2/2004 Gerber ..... A23G 9/045 222/135
6,808,091 B2 * 10/2004 Njaastad ..... B67D 1/0048 222/459
6,871,761 B2 3/2005 Fox
7,059,761 B2 6/2006 Gerber
7,717,297 B2 5/2010 Kadyk et al.
7,913,878 B1 * 3/2011 Baron ..... B67D 1/0043 222/129.1
8,403,179 B1 * 3/2013 Gerber ..... B67D 1/0036 222/129.1
8,511,516 B2 * 8/2013 Klopfenstein ..... B67D 1/0031 222/190
8,807,392 B2 * 8/2014 Smeller ..... A47J 31/402 222/129.1
9,131,709 B2 * 9/2015 Hammonds ..... A23G 9/045
10,138,107 B2 * 11/2018 Zemko ..... B67D 1/0021
2001/0011660 A1 8/2001 Schroeder et al.
2003/0161923 A1 8/2003 Holland et al.
2005/0051577 A1 3/2005 Loeb et al.
2005/0067433 A1 * 3/2005 Brandt ..... B67D 1/0043 222/145.5
2008/0073376 A1 * 3/2008 Gist ..... A23G 9/045 222/145.5
2009/0230149 A1 9/2009 Smeller et al.
2010/0147875 A1 6/2010 Santos et al.
2013/0200103 A1 * 8/2013 Gates ..... B67D 7/74 222/145.5
2014/0092705 A1 * 4/2014 Riel ..... B01F 15/0216 366/142
2014/0263414 A1 * 9/2014 San Miguel ..... A23G 9/045 222/1
2015/0335208 A1 * 11/2015 Ciavarella ..... A47K 5/1211 222/65
2016/0229675 A1 * 8/2016 Popov ..... B67D 1/0021
2018/0126427 A1 * 5/2018 Haselwood ..... B08B 9/0328

* cited by examiner

FROZEN BEVERAGE DISPENSING MACHINES WITH MULTI-FLAVOR VALVES

CROSS-REFERENCE TO RELATED APPLICATION

This application is a continuation of U.S. patent application Ser. No. 15/585,974, filed, May 3, 2017, which is incorporated herein by reference in entirety, and claims priority to U.S. Provisional Patent Application Ser. No. 62/332,258 filed May 5, 2016, the disclosure of which is incorporated herein by reference.

FIELD

The present disclosure relates to frozen beverage dispensing machines with multi-flavor valves.

BACKGROUND

The following U.S. Patent and U.S. Patent Application are incorporated herein by reference in entirety.

U.S. Patent Application Publication No. 2010/0147875 discloses a device for introducing additive fluids to a primary fluid that includes a body having a central bore for flow therethrough of a stream of primary fluid and a plurality of fluid flow channels in the body. Each channel extends between an inlet to the channel for connection to an associated supply of additive fluid and a plurality of outlet orifices from the channel that open into a surface of the body around and outside of an exit from the central bore.

U.S. Pat. No. 6,220,047 discloses a dual purpose carbonator/blending bottle connected to a source of beverage syrup, a source of potable water and to a source of pressurized carbon dioxide gas. The dual purpose bottle is retained within an ice bank water bath tank. A pair of ratio valves provide for metering the water and syrup at a desired ratio. The mixed beverage first flows through a serpentine coil, also located in water bath, and then flow into the dual purpose bottle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage machine includes a valve that receives a base fluid and dispenses a mixed beverage comprising the base fluid and an additive fluid. The valve has a bore through which the base fluid flows, and the bore has a perimetral surface that defines a plurality of ports through which the additive fluid is injected to thereby mix with the base fluid. An injector is coupled to the valve and configured to radially inject the additive fluid into the base fluid through the plurality of ports as the base fluid flows through the bore such that the additive fluid mixes into the base fluid to form the mixed beverage.

In certain examples, a beverage machine includes a valve that receives a base fluid and dispenses a mixed beverage comprising the base fluid and an additive fluid. The valve has a bore through which the base fluid flows, and the bore has an upstream end that receives the base fluid, a perimetral surface that defines a plurality of ports through which the additive fluid is injected to thereby mix with the base fluid, and a downstream end that dispenses the mixed beverage. An injector is coupled to the valve and configured to radially inject the additive fluid into the base fluid through the plurality of ports as the base fluid flows through the bore such that the additive fluid mixes into the base fluid to form the mixed beverage. A baffle is positioned in the bore downstream of the injector and configured to redirect the base fluid and the additive fluid to thereby further mix the additive fluid into the base fluid. A deflection member is positioned in the bore downstream of the baffle and configured to further mix the additive fluid into the base fluid. The deflection member has a center column and a plurality of fins that radially extend from the center column.

In certain examples, a method of dispensing a mixed beverage including a base fluid and an additive fluid includes receiving, with a valve having a bore with an upstream inlet end, the base fluid; injecting, with an injector coupled to the valve, the additive fluid through a plurality of ports in a perimetral surface of the bore radially into the base fluid as the base fluid flows through the valve such that the additive fluid mixes with the base fluid to form the mixed beverage; and dispensing the mixed beverage from the downstream end of the bore.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

Figure 1:
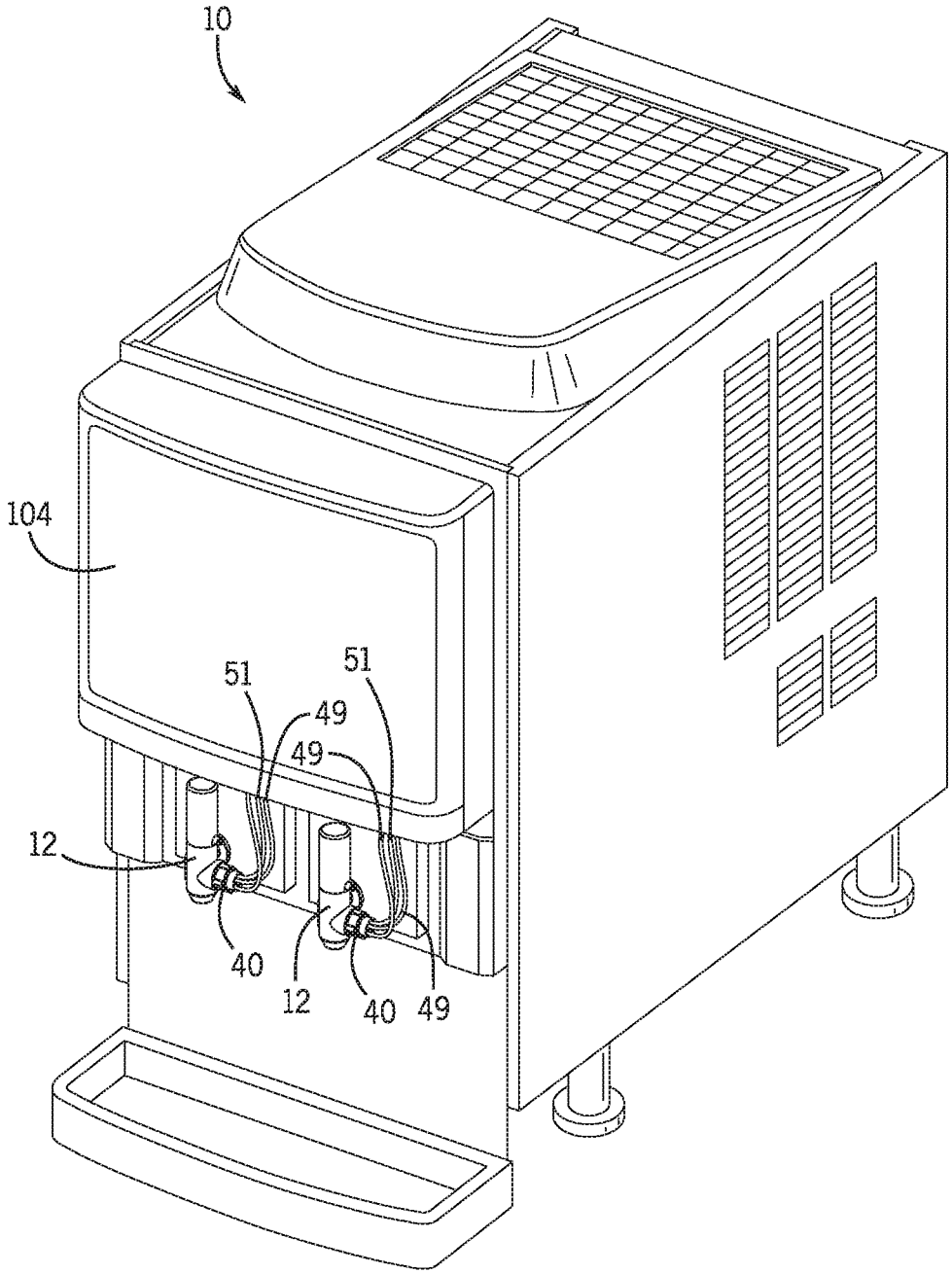
FIG. 1 is a perspective view of an example beverage machine with two valves.
Figure 2:
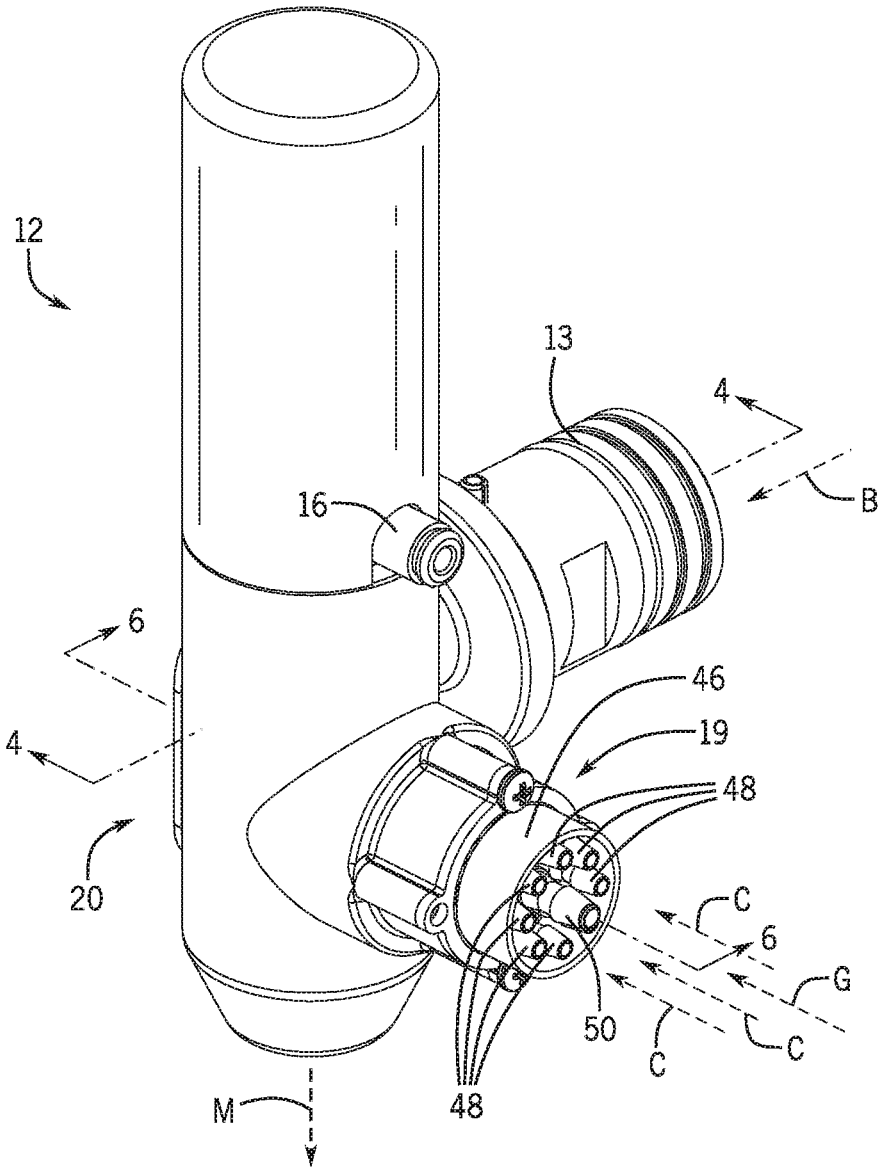
FIG. 2 is a perspective view of an example valve.
Figure 3:
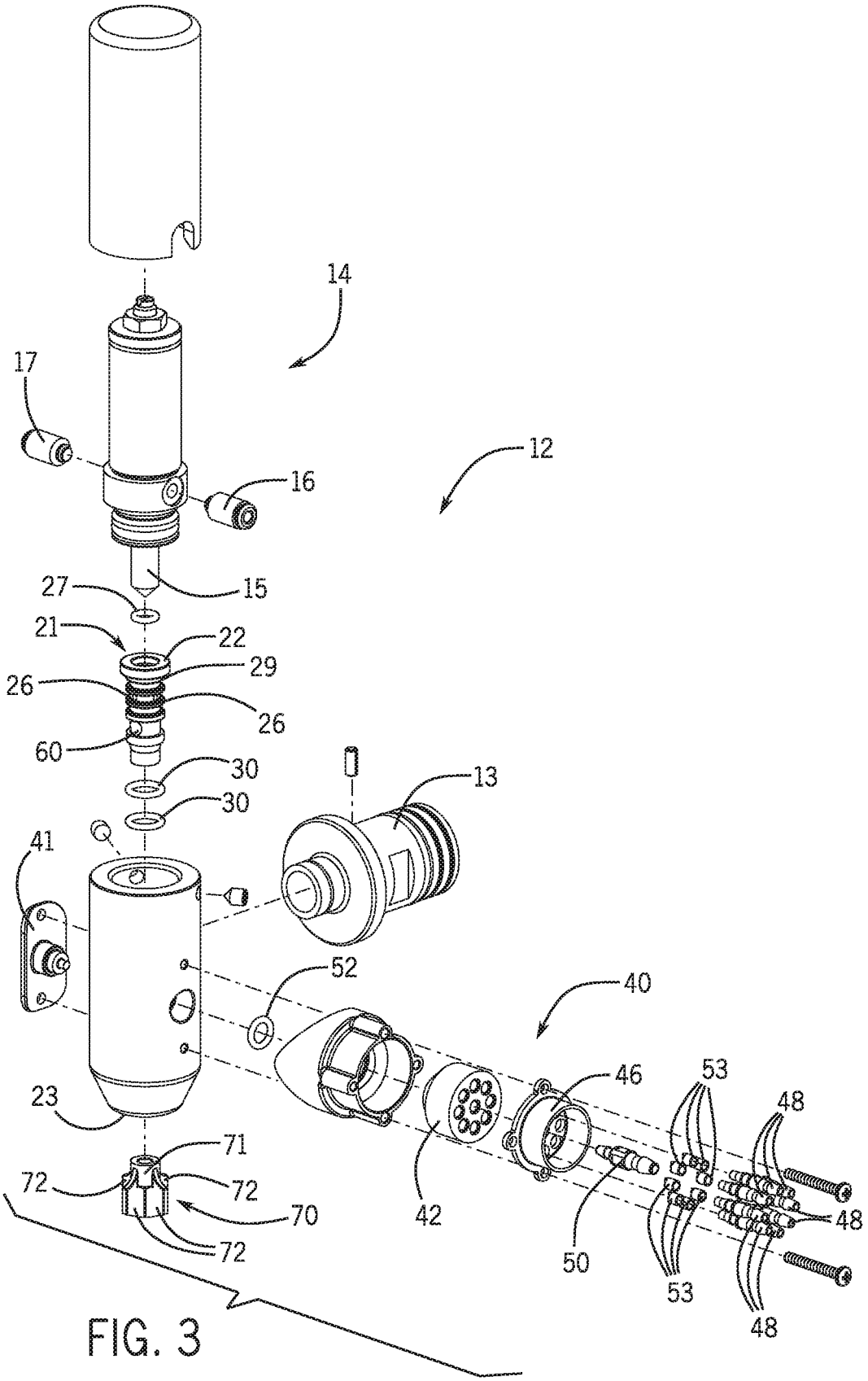
FIG. 3 is an exploded view showing the valve of FIG. 2.

FIG. 1 is an example beverage dispensing machine 10 that dispenses a custom mixed beverage to an operator. The beverage machine 10 includes at least one valve 12 (described further herein) that receives a base fluid (e.g. a liquid/frozen slush fluid, a carbonated liquid/frozen slush fluid) (see base fluid lines B in FIGS. 5 and 7) and dispenses a mixed beverage (e.g. a vanilla cherry flavored carbonated liquid/frozen slush mixed beverage) (see mixed fluid lines M in FIGS. 5 and 7) comprising the base fluid and an additive fluid (e.g. cherry flavoring syrup, vanilla flavoring syrup) (see additive fluid lines A in FIGS. 5 and 7). The number of valves 12 included with the beverage machine 10 can vary. Reference is made to the above-incorporated U.S. Pat. No. 6,220,047 for further description of conventional frozen beverage dispensing machines.

FIGS. 2-7 depict an example valve 12. The valve 12 includes a fitting 13 that couples to the beverage machine 10 (FIG. 1) and receives the base fluid B from a base fluid source (not shown; e.g. a container enclosed in the beverage machine 10). The valve 12 has a bore 21 (FIG. 4) through which the base fluid B flows, and the bore 21 comprises an upstream inlet end 22 that receives the base fluid B, a perimetral surface 24 that defines a plurality of ports 26 through which the additive fluid A is injected to thereby mix with the base fluid B, and a downstream outlet end 23 that dispenses the mixed beverage M. In certain examples, the valve 12 has a channel 28 (FIG. 4) that surrounds the bore 21 and is configured to convey the additive fluid A from the injector 40 to each of the ports 26. In certain examples, the valve 12 includes an insert 29 (FIGS. 3-4) positioned in the bore 21 to define the channel 28. The valve 12 also includes a pair of o-rings 30 configured to create a fluid tight seal between the insert 29 and the valve 12.

Figure 4:
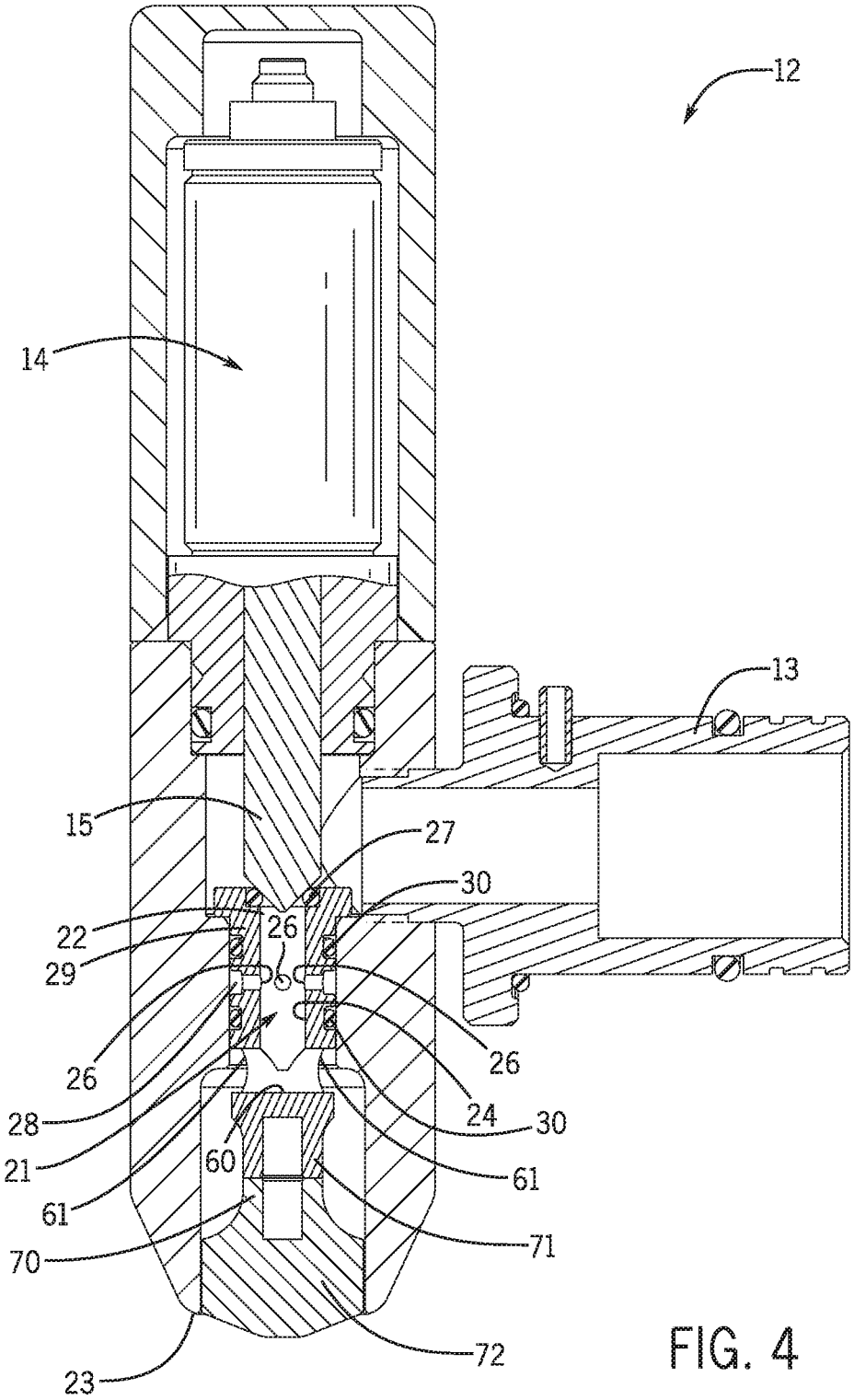
FIG. 4 is a cross sectional view along line 4-4 on FIG. 2 with a piston rod in a closed position.
Figure 6:
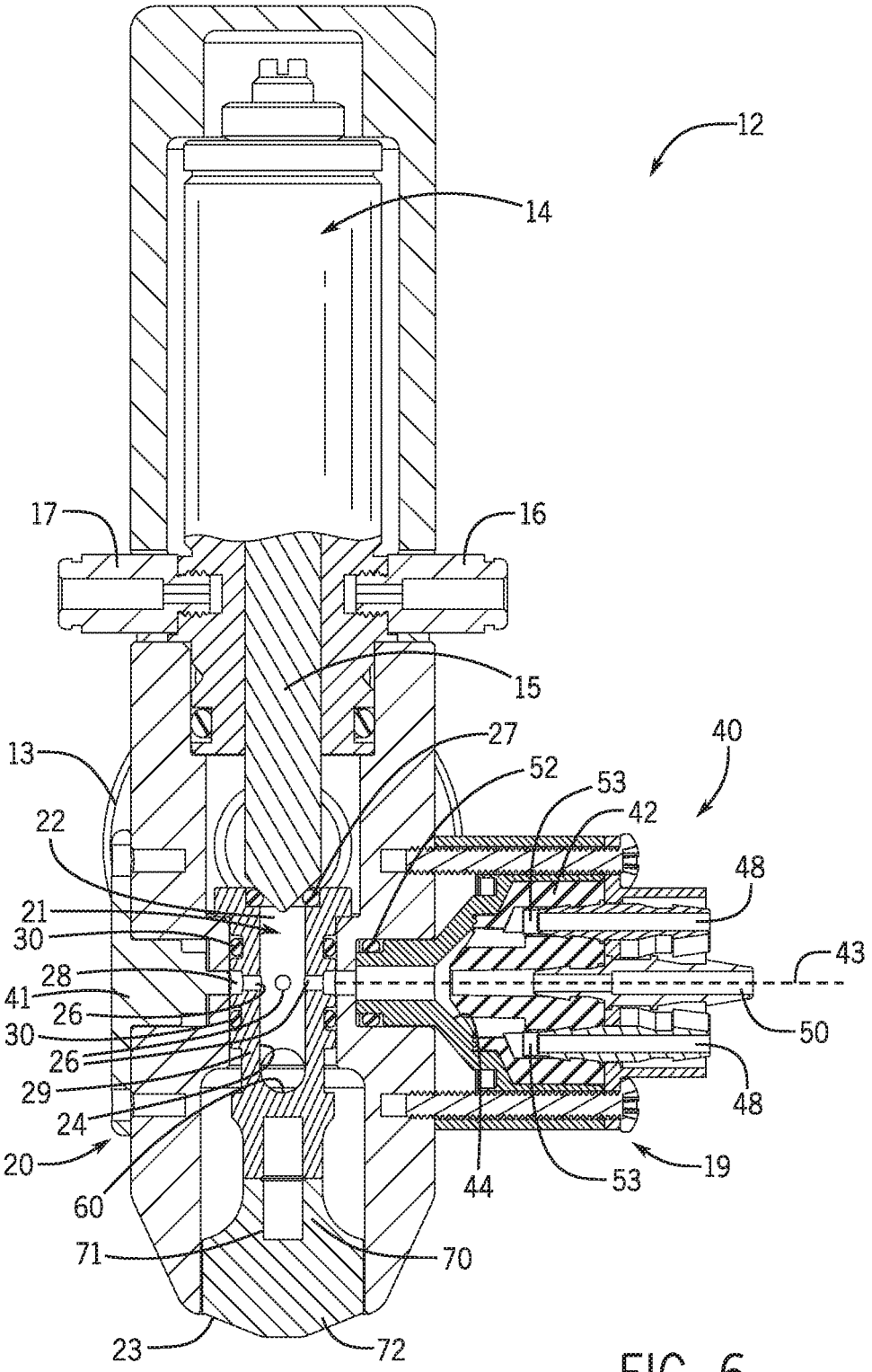
FIG. 6 is a cross sectional view along line 6-6 on FIG. 2 with the piston rod in the closed position.
Figure 7:
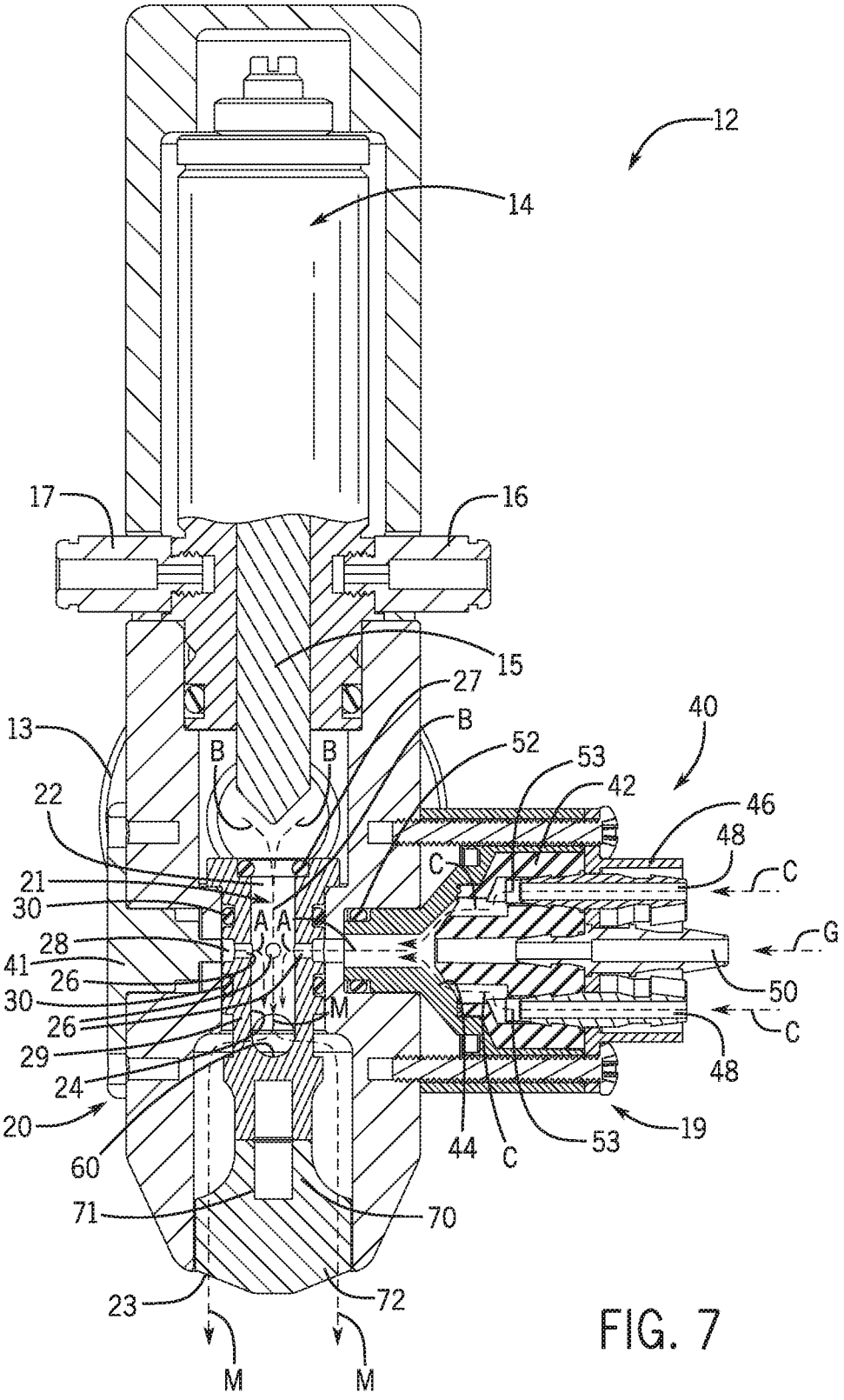
FIG. 7 is a view like FIG. 6 with the piston rod in the open position.
Figure 11:
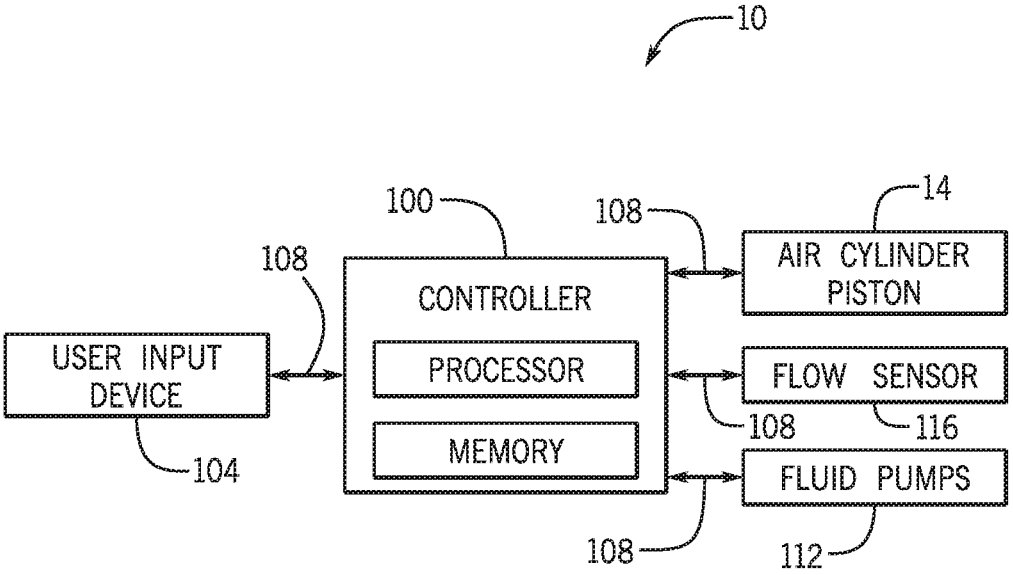
FIG. 11 is an example system diagram.

The valve 12 has an air cylinder piston 14 configured to selectively move a piston rod 15 into and between a closed position (FIGS. 4 and 6) in which a piston rod 15 blocks/prevents the base fluid B from flowing through the valve 12 and an open position (FIGS. 5 and 7) in which the piston rod 15 moves to thereby allow the base fluid B to flow through the valve 12. That is, when the piston rod 15 is in the open position (FIGS. 5 and 7), the base fluid B flows through the valve 12 from the base fluid source and when the piston rod 15 is in the closed position (FIGS. 4 and 6), the piston rod 15 prevents the base fluid from flowing through the valve 12. In certain examples, the valve 12 includes a resilient member 27 positioned at the upstream inlet end 22 and configured to create a fluid tight seal between the piston rod 15 and the bore 21 when the air cylinder piston 14 is in a closed position (FIGS. 4 and 6). The air cylinder piston 14 is coupled to a gas inlet 16 and a gas outlet 17 (FIGS. 6-7). The air cylinder piston 14 can be manually operated and/or controlled by a controller 100 (FIG. 11). The size and shape of the resilient member 27 can vary (e.g. the resilient member 27 is an o-ring). The type and configuration of the air cylinder piston 14 can include commercially available air cylinder pistons available from Bimba (Part No. COL-0017744-A-BR). One having ordinary skill in the art will recognize that other types of devices and/or valves (e.g. electric solenoid, stepper motor) can be used to control the flow of base fluid B through the valve 12.

The valve 12 includes a baffle 60 (FIG. 4) positioned in the bore 21 downstream of the injector 40 and configured to redirect the base fluid B and the additive fluid A to thereby further mix the additive fluid A into the base fluid B. The baffle 60 includes radially orientated holes 61 (FIG. 4) through which the additive fluid A and the base fluid B flow. In certain examples, the baffle 60 is configured redirect the base fluid B and the additive fluid A from an axial flow to a radial flow (FIG. 5)

The valve 12 includes a deflection member 70 (FIG. 4) positioned in the bore 21 downstream of the baffle 60 and configured to further mix the additive fluid A into the base fluid B. The deflection member 70 has a center column 71 and a plurality of fins 72 that radially extend from the center column 71.

Figure 5:
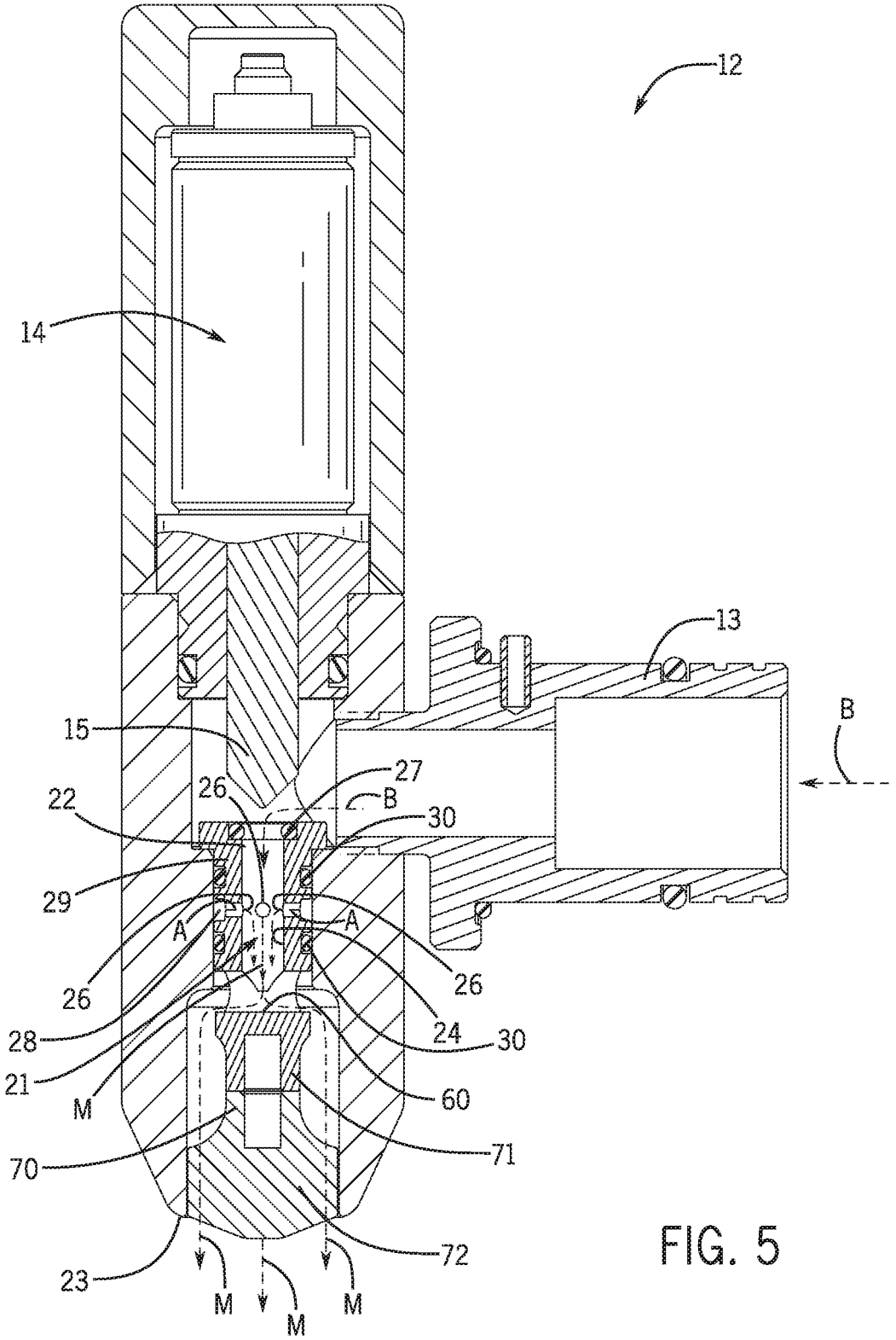
FIG. 5 is a view like FIG. 4 with the piston rod in an open position.

The beverage machine 10 includes an injector 40 coupled to the valve 12 and configured to radially inject the additive fluid A into the base fluid B through the plurality of ports 26 as the base fluid B flows through the bore 21 such that the additive fluid A mixes into the base fluid B to form the mixed beverage M (see FIGS. 5 and 7). That is, the additive fluid A is injected into the base fluid B in a direction that is transverse to the base fluid B as the base fluid B flows through the bore 21. The additive fluid A can include any number of fluid components (e.g. nutrients, flavoring syrups, acids, sweeteners) (see fluid components lines C in FIG. 7). For instance, the additive fluid A can be a first fluid component (e.g. cherry flavoring syrup), a second fluid component (e.g. vanilla flavoring syrup), or a mixed fluid component (e.g. a cherry-vanilla flavoring syrup) formed from the first fluid component and the second fluid component.

Figure 8:
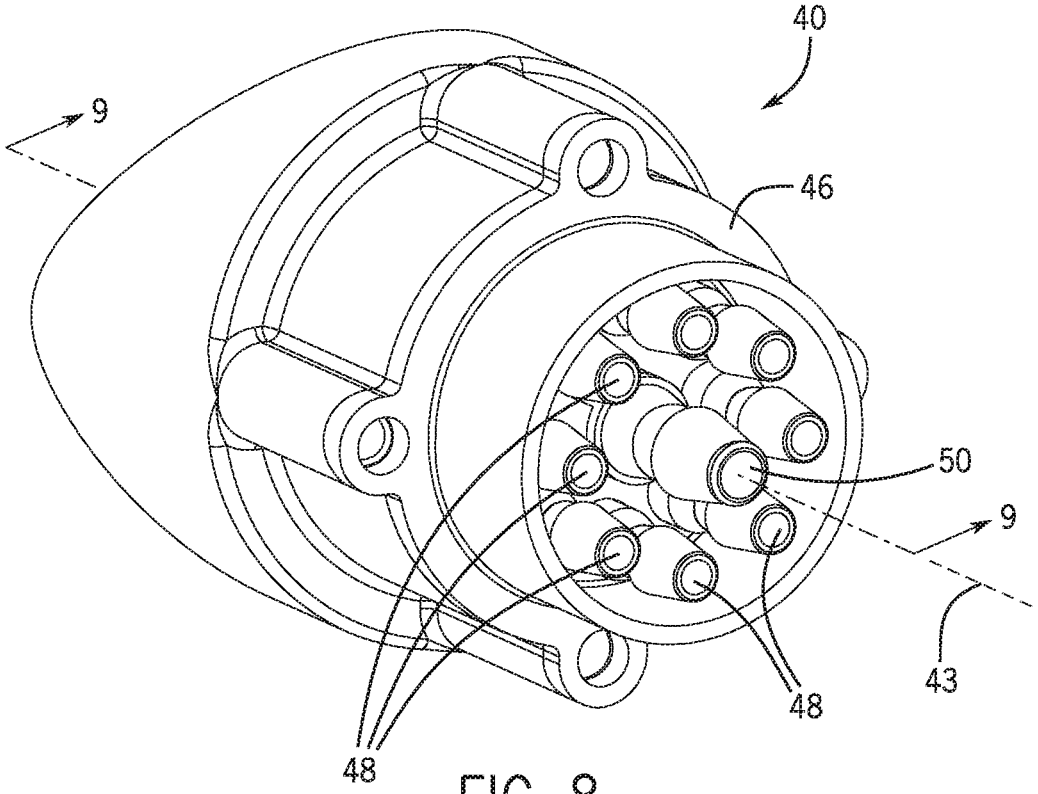
FIG. 8 is an example injector.
Figure 9:
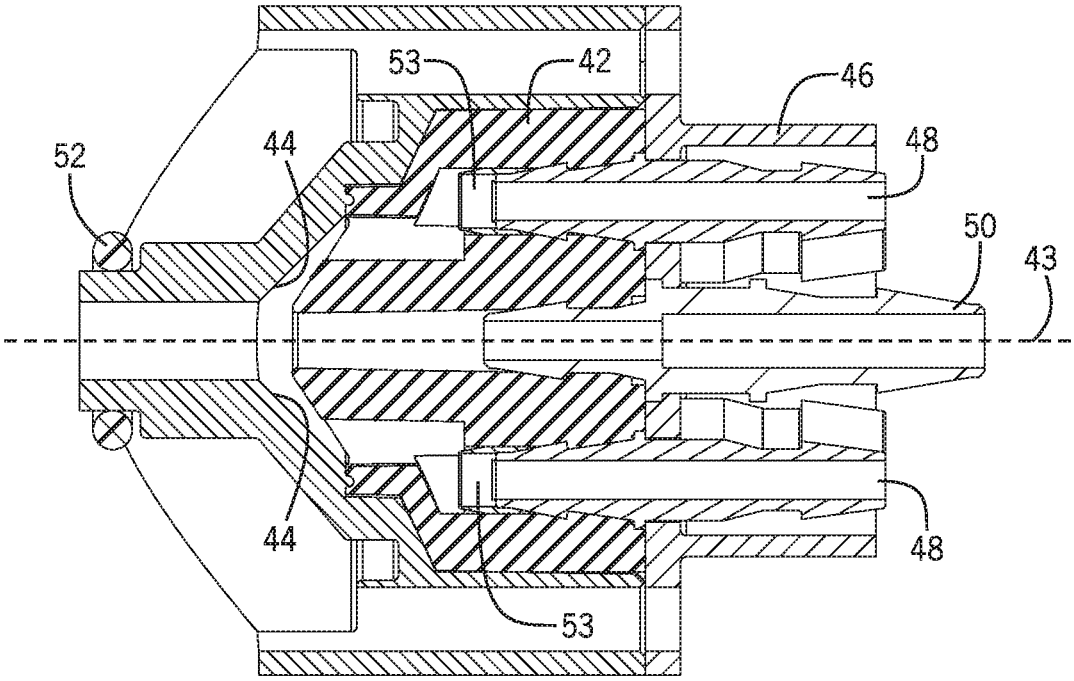
FIG. 9 is a cross sectional view along line 9-9 on FIG. 8.
Figure 10:
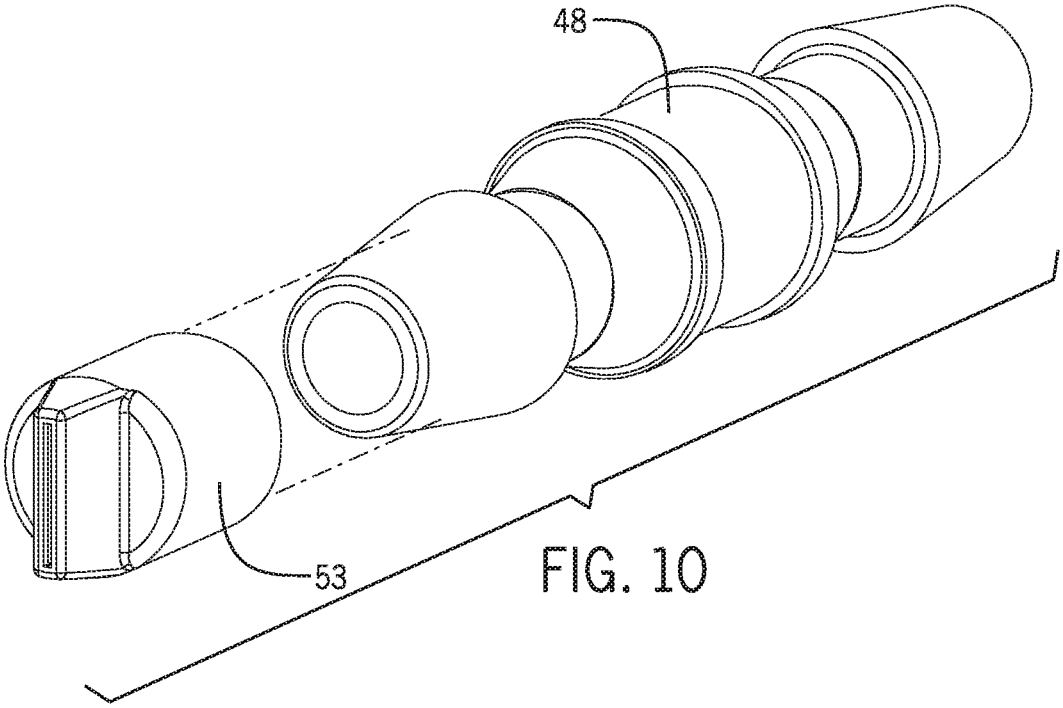
FIG. 10 is an example barbed fitting and an example duckbill valve.

The injector 40 includes a manifold 42 (FIG. 6) that receives the first fluid component and the second fluid component and dispenses one or more of the first fluid component, the second fluid component, and the mixed fluid component. The manifold 42 is configured to convey the first fluid component and the second fluid component parallel to an injector axis 43 (FIG. 6) The number of fluid components that can be received and dispensed by the manifold 42 can vary, and in the example depicted in FIG. 8, the manifold 42 can receive up to eight fluid components. The injector 40 includes a plurality of barbed fittings 48 that are removably coupled to the manifold 42. The barbed fittings 48 receive the fluid components C from fluid component sources (not shown; e.g. a syrup cartridges, a bag-in-box containers) via fluid supply lines 49 (FIG. 1) which are connected to the barbed fittings 48. One having ordinary skill in the art will recognize that the fluid components can be conveyed or supplied to the injector 40 via the fluid supply lines 49 by conventional devices and systems, e.g. fluid pumps 112 (FIG. 10). In certain examples, check valves or duckbill valves 53 (see FIGS. 3, 6-7, and 10) are coupled to each of the barbed fittings 48 and configured to prevent the fluid components from backflowing toward the fluid component sources. In certain examples, the injector 40 has a cover 46 removably coupled to the injector 40 and configured to protect the manifold 42 from debris and contamination.

The injector 40 extends along an injector axis 43, and the injector 40 has a surface 44 centered about the injector axis 43. The surface 44 is configured to radially inwardly direct the fluid components C dispensed from the manifold 42 toward the injector axis 43 (FIG. 7). The shape of the surface 44 can vary, and in the example depicted, the surface is a frustoconical surface.

In certain examples, the manifold 42 is further configured to receive and dispense a gas (e.g. N2, O2, CO2) and the injector 40 is further configured to inject the gas into the valve 12 to thereby clear residual additive fluid A from the valve 12 after the mixed beverage M has been dispensed. That is, the injector 40 includes a gas barbed fitting 50 that is removably coupled to the manifold 42 and the gas barbed fitting 50 receives the gas from a gas source (not shown; e.g. a CO2 gas tank) via a gas supply line 51 (FIG. 1) which is connected to the gas barbed fitting 50. In operation, when the gas is dispensed by the manifold 42, the gas forces or clears the residual additives fluid from the injector 40, the channel 28, the plurality of ports 26, and/or the valve 12. The dispense of the gas from the manifold 42 can be manually controlled and/or controlled by a controller 100 (FIG. 11).

The orientation of the injector 40 relative to the valve 12 can vary. For example, the injector 40 can be configured such that the injector 40 injects the additive fluid A into the base fluid B via a first side 19 (FIGS. 6-7) of the valve 12 or an opposite, second side 20 (FIGS. 6-7) of the valve 12. The injector 40 includes a plug 41 that is coupled to the valve 12 on the side of the valve 12 opposite the side of the valve 12 through which the injector 40 injects the additive fluid A into the base fluid B (e.g. in FIGS. 6-7 the additive fluid A is injected into the base fluid B via the first side 19 of the valve 12 and the plug 41 is coupled to the second side 20 of the valve 12). The plug 41 is configured to cover or fill any voids/spaces of the valve 12, and the plug 41 can be removed during maintenance and/or cleaning. The plug 41 also allows an operator to mount the injector 40 and/or the manifold 42 to either side 19, 20 of the valve 12 to accommodate beverage machines 10 (FIG. 11) with different clearance or mounting requirements (e.g. the beverage machine 10 is positioned against a wall and the injector 40 can only be coupled to the first side 19 of the valve 12). In certain examples, the injector 40 includes an o-ring 52 configured to create a fluid tight seal between the injector 40 and the valve 12.

Referring to FIG. 11, the beverage machine includes a computer controller 100 in communication with various components of the beverage machine 10 described herein. The controller 100 controls the beverage machine 10 in accordance with inputs received by a user input device 104 positioned on the beverage machine 10 (FIG. 1). In other examples, the user input device 104 can be remote to the beverage machine 10. The type and configuration of the user input device 104 and the controller 100 can vary from that which is shown. The user input device 104 can include one or more conventional input devices for inputting operator or user selections to the controller 100. Exemplary user input devices 104 include touch screens, mechanical buttons, mechanical switches, voice command receivers, tactile command receivers, gesture sensing devices, and/or remove controllers such as personal digital assistant(s) (PDAs), handheld(s), laptop computer(s), and/or the like.

The controller 100 can be located in beverage machine 10 and/or can be located remotely from beverage machine 10. In some examples, the controller 100 can be configured to communicate via the Internet or any other suitable communication link. Although FIG. 11 shows one controller 100, there can be more than one controller 100. Portions of the methods described herein can be carried out by a single controller or by several separate controllers. Each controller can have one or more control sections or control units. In some examples, the controller 100 can include a computing system that includes a processing system, storage system, software, and input/output (I/O) interfaces (e.g. user input device 104) for communicating with devices described herein and/or with other devices. The processing system can load and execute software from the storage system. The controller 100 may include one or many application modules and one or more processors, which may be communicatively connected. The processing system may comprise a microprocessor and other circuitry that retrieves and executes software from the storage system. Non-limiting examples of the processing system include general purpose central processing units, applications specific processors, and logic devices. The storage system can comprise any storage media readable by the processing system and capable of storing software. The storage system can include volatile and non-volatile, removable and non-removable media implemented in any method or technology for storage of information, such as computer readable instructions, data structures, program modules, or other data.

The controller 100 communicates with one or more components of the beverage machine 10 via one or more communication links 108, which can be a wired or wireless links. The controller 100 is capable of monitoring and/or controlling one or more operational characteristics of the beverage machine 10 and its various subsystems by sending and receiving control signals via the communication links 108. It should be noted that the extent of connections of the communication link 108 shown herein is for schematic purposes only, and the communication links 108 in fact provides communication between the controller 100 and each of the devices and various subsystems described herein, although not every connection is shown in the drawing for purposes of clarity.

The controller 100 is in communication with the user input device 104, the air cylinder piston 14, and the fluid pumps 112 that pump the fluid components to the injector 40, and the controller configured to control the air cylinder piston 14 and the fluid pumps 112 based on the input received via the user input device 104. The input received via the user input device 104 can correspond to the custom mixed beverage to be dispensed, and controller 100 is configured to interpret the input received via the user input device 104 and thereby control the air cylinder piston 14 and the fluid pumps 112 such that the custom mixed beverage dispenses from the valve 12. The controller 100 can also be in communication with flow sensors 116 or other sensors such that the controller 100 controls the air cylinder piston 14 and the fluid pumps 112 based on fluid flow characteristics or machine operation characteristics sensed by the flow sensors 116 or other sensors.

The beverage machine 10 can include a method or method steps of dispensing the mixed beverage M. The method can comprise the steps of: receiving, with a valve 12 having a bore 21 with an upstream inlet end 22, the base fluid B, wherein the bore 21 has a downstream outlet end 23 and a perimetral surface 24 that defines a plurality of ports 26; injecting, with an injector 40 coupled to the valve 12, the additive fluid A through the plurality of ports 26 radially into the base fluid B as the base fluid B flows through the valve 12 such that the additive fluid A mixes with the base fluid B to form the mixed beverage M; and dispensing the mixed beverage M from the downstream end of the bore 21. The method can also comprise providing a baffle 60 in the bore 21 downstream of the injector 40 to further mix the additive fluid A into the base fluid B and/or providing a deflection member 70 in the bore 21 downstream of the baffle 60 to further mix the additive fluid A into the base fluid B.

The present inventors of the present disclosure have also recognized a problem that the air cylinder piston 14 can occasionally become blocked by frozen particles and/or ice chips from the base fluid source (not shown) such that the valve 12 malfunctions (e.g. remain open, remain closed). Through research and experimentation, the present inventors have discovered that frozen particles and/or ice chips can be cleared from the air cylinder piston 14 by repeatably reciprocating the air cylinder piston 14, for example in a rapidly successive manner. That is, the air cylinder piston 14 can be repeatably reciprocated by alternating the air flow to and from the gas inlet 16 and gas outlet 17 such that the air cylinder piston 14 rapidly reciprocated between the closed position (FIGS. 4 and 6) and the open position (FIGS. 5 and 7) which vibrates/breaks-up the frozen particles and/or ice chips blocking the valve 12. The controller 100 can be configured to reciprocate the air cylinder piston 14, as described above, when a corresponding input in received from the user input device 104 and/or when the controller 100 determines via electronic signals from flow sensors 116 that frozen particles and/or ice chips block the valve 12. In certain examples, the beverage machine 10 includes the method of dispensing the beverage from the valve 12 including receiving, by way of the controller 100 a signal from the user input device 104 that indicates that the valve 12 blocked and controlling the air cylinder piston 14 such that air cylinder piston 14 reciprocates to unblock the valve 12.

What is claimed is:

1. A beverage machine comprising:

a valve that receives a base fluid and dispenses a mixed beverage comprising the base fluid and an additive fluid, the valve having a bore through which the base fluid is conveyed and a channel that surrounds the bore and through which the additive fluid flows to a plurality of ports that radially inject the additive fluid into the bore, such that the additive fluid mixes with the base fluid to form the mixed beverage; and an injector coupled to the valve and configured to radially inject the additive fluid into the channel such that the additive fluid flows through the channel and the plurality of ports and into the bore, the injector having a manifold configured to receive and dispense a plurality of fluid components, which mix to form the additive fluid;

wherein the injector has an outlet through which the additive fluid is conveyed from the injector to the channel, and a surface configured to radially inwardly direct the additive fluid toward the outlet;

wherein the injector has an injector axis on which the outlet is centered;

wherein the plurality of fluid components received by the manifold encircles the injector axis; and wherein the injector further has a gas fitting centered on the injector axis and configured to radially inject air into the channel and then radially into the bore via the plurality of ports to thereby purge the valve after use.

2. The beverage machine according to claim 1, wherein the surface is a frustoconical surface centered on the injector axis.

3. The beverage machine according to claim 2, wherein the bore has an upstream end that receives the base fluid and a downstream end that dispenses the mixed beverage; and wherein the valve comprises a baffle positioned in the bore downstream of the injector and configured to redirect the base fluid and the additive fluid to thereby further mix the additive fluid into the base fluid.

4. The beverage machine according to claim 3, wherein the baffle is configured to redirect the base fluid and the additive fluid from an axial flow to a radial flow.

5. The beverage machine according to claim 4, wherein the valve further comprises a deflection member positioned in the bore downstream of the baffle and configured to further mix the additive fluid into the base fluid.

6. The beverage machine according to claim 5, wherein the deflection member comprises a center column and a plurality of fins that radially extend from each other and from the center column.

7. A beverage machine comprising:

a valve that receives a base fluid and dispenses a mixed beverage comprising the base fluid and an additive fluid, the valve having a bore through which the base fluid is conveyed and a channel that surrounds the bore and through which the additive fluid flows to a plurality of ports that radially inject the additive fluid into the bore, such that the additive fluid mixes with the base fluid to form the mixed beverage; and an injector coupled to the valve and configured to radially inject the additive fluid into the channel such that the additive fluid flows through the channel and the plurality of ports and into the bore, the injector having a manifold configured to receive and dispense a plurality of fluid components, which mix to form the additive fluid;

wherein the bore has an upstream end that receives the base fluid and a downstream end that dispenses the mixed beverage;

wherein the valve comprises a baffle positioned in the bore downstream of the injector and configured to redirect the base fluid and the additive fluid to thereby further mix the additive fluid into the base fluid;

wherein the baffle is configured to redirect the base fluid and the additive fluid from an axial flow to a radial flow;

wherein the valve further comprises a deflection member positioned in the bore downstream of the baffle and configured to further mix the additive fluid into the base fluid;

wherein the deflection member comprises a center column and a plurality of fins that radially extend from each other and from the center column; and wherein the injector has an outlet through which the additive fluid is conveyed from the injector to the channel, and a surface configured to radially inwardly direct the additive fluid toward the outlet; wherein the injector has an injector axis on which the outlet is centered; wherein the plurality of fluid components received by the manifold encircles the injector axis; and wherein the injector further has a gas fitting centered on the injector axis and configured to radially inject air into the channel and then radially into the bore via the plurality of ports to thereby purge the valve after use.

8. A beverage machine comprising:

a valve that dispenses a mixed beverage comprising a base fluid and an additive fluid, the valve comprising a bore through which the base fluid is conveyed and a channel that surrounds the bore and along which the additive fluid flows to a plurality of ports which radially inject the additive fluid into the bore such that the additive fluid mixes with the base fluid to thereby form the mixed beverage; and an injector coupled to the valve and configured to inject the additive fluid into the channel, the injector comprising a manifold configured dispense a plurality of fluid components that forms the additive fluid and further comprising a gas fitting that radially injects a gas into the bore via the channel and the plurality of ports;

wherein the injector is configured to inject a first one of the plurality of fluid components into the channel such that the first one of the plurality of fluid components flows along the channel and then into the bore via all of the plurality of ports, wherein the injector is further configured to thereafter inject the gas into the bore via the channel and all of the plurality of ports to thereby purge the first one of the plurality of fluid components from the channel and all of the plurality of ports, wherein the injector is further configured to thereafter inject a different second one of the plurality of fluid components into the channel such that the different second one of the plurality of fluid components flows along the channel and then into the bore via all of the plurality of ports, and wherein the injector is configured to thereafter again inject the gas into the bore via the channel and all of the plurality of ports to thereby purge the different second one of the plurality of fluid components from the channel and all of the plurality of ports.

9. The beverage machine according to claim 8, wherein the bore has an upstream end that receives the base fluid and a downstream end that dispenses the mixed beverage, and further wherein the valve comprises a baffle positioned in the bore downstream of the injector and configured to redirect the base fluid and the additive fluid to thereby further mix the additive fluid into the base fluid.

10. The beverage machine according to claim 9, wherein the baffle is configured to redirect the base fluid and the additive fluid from an axial flow to a radial flow.

11. The beverage machine according to claim 8, wherein the valve further comprises a deflection member positioned in the bore downstream of the baffle and configured to further mix the additive fluid into the base fluid.

12. The beverage machine according to claim 11, wherein the deflection member comprises a center column and a plurality of fins that radially extend from each other and from the center column.

* * * * *